US009587537B2

(12) United States Patent
Allison

(10) Patent No.: US 9,587,537 B2
(45) Date of Patent: Mar. 7, 2017

(54) TRIPLE BAFFLED MUFFLER

(71) Applicant: Dave Allison, Juneau, AK (US)

(72) Inventor: Dave Allison, Juneau, AK (US)

( * ) Notice: Subject to any disclaimer, the term of this patent is extended or adjusted under 35 U.S.C. 154(b) by 0 days.

(21) Appl. No.: 14/957,230

(22) Filed: Dec. 2, 2015

(65) Prior Publication Data

US 2016/0160718 A1 Jun. 9, 2016

Related U.S. Application Data

(60) Provisional application No. 62/088,619, filed on Dec. 7, 2014.

(51) Int. Cl.

| | |
|---|---|
| ***F01N 1/08*** | (2006.01) |
| ***F01N 1/16*** | (2006.01) |
| ***F01N 1/18*** | (2006.01) |
| *F01N 1/00* | (2006.01) |

(52) U.S. Cl.

CPC ..... *F01N 1/165* (2013.01); *F01N 1/166* (2013.01); *F01N 1/168* (2013.01); *F01N 1/18* (2013.01)

(58) Field of Classification Search

CPC . F01N 1/165; F01N 1/168; F01N 1/18; F01N 1/163; F01N 1/166; F01N 2470/30; F16K 17/02; F16K 17/04; F16K 17/12; F16K 17/164

USPC ..... 181/197, 236, 237, 271, 277, 278; 137/527, 527.8, 527.6

See application file for complete search history.

(56) References Cited

U.S. PATENT DOCUMENTS

| | | | | | |
|---|---|---|---|---|---|
| 987,946 | A * | 3/1911 | Bergler | F16K 47/10 | 137/513.3 |
| 1,153,097 | A * | 9/1915 | Miller | F01N 1/165 | 181/278 |
| 1,162,239 | A * | 11/1915 | Johnsgaard | F16K 15/02 | 137/519 |
| 1,375,621 | A * | 4/1921 | Wright, Jr. | F01N 1/166 | 181/236 |
| 1,615,564 | A * | 1/1927 | Beery | F01N 1/08 | 137/601.18 |
| 1,709,426 | A * | 4/1929 | Beery | F01N 1/084 | 137/527 |
| 2,083,516 | A * | 6/1937 | Horton | F01N 1/166 | 137/512 |
| 2,404,589 | A * | 7/1946 | Monaghan | F01N 1/003 | 181/232 |
| 3,638,756 | A | 2/1972 | Thiele | | |
| 3,982,560 | A * | 9/1976 | Dibert | F24F 11/043 | 137/527.8 |
| 3,996,961 | A * | 12/1976 | Siegwart | F16K 1/22 | 137/517 |
| 4,161,996 | A | 7/1979 | Dolejsi | | |
| 4,396,034 | A * | 8/1983 | Cherniak | F16K 15/033 | 137/514 |

(Continued)

*Primary Examiner* — Edgardo San Martin

(74) *Attorney, Agent, or Firm* — The Gray Law Group, LTD; Robert W. Gray

(57) ABSTRACT

A triple-baffled muffler enables an engine sound that changes from very quiet when idling to louder as the throttle is pressed. The muffler provides three baffles which are hinged over the center of the muffler. The exhaust pressure travels through the muffler and pushes the baffles until they open to release the pressure. The angle of incidence of the baffles on their hinges governs the loudness of the sound.

16 Claims, 3 Drawing Sheets

(56) References Cited

U.S. PATENT DOCUMENTS

| | | | | | |
|---|---|---|---|---|---|
| 4,609,068 | A * | 9/1986 | Backlund | F01N 13/082 | 181/226 |
| 4,699,244 | A * | 10/1987 | Bergquist | F01N 1/165 | 181/226 |
| 4,903,486 | A | 2/1990 | Finkle | | |
| 5,036,948 | A | 8/1991 | Henn | | |
| 5,305,787 | A * | 4/1994 | Thygesen | F16K 15/033 | 137/527 |
| 6,098,495 | A * | 8/2000 | Wang | F16K 1/2263 | 74/102 |
| 7,434,570 | B2 * | 10/2008 | Hill | F01N 1/006 | 123/568.18 |
| 7,451,854 | B2 * | 11/2008 | Suzuki | F01N 1/165 | 181/237 |
| 7,673,720 | B2 * | 3/2010 | Meneely | F01N 1/02 | 181/212 |
| 8,136,629 | B2 | 3/2012 | Inoue | | |
| 8,453,672 | B2 * | 6/2013 | Abram | F01N 1/08 | 137/527 |
| 2008/0314679 | A1 | 12/2008 | Rowe | | |
| 2010/0313554 | A1 * | 12/2010 | Abram | F01N 1/08 | 60/324 |

* cited by examiner

TRIPLE BAFFLED MUFFLER

CROSS-REFERENCE TO RELATED APPLICATIONS

This Application claims the benefit of U.S. Provisional Application No. 62/088,619, filed Dec. 7, 2014, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to exhaust system components and in particular to a triple-baffled muffler. The art of customizing a vehicle sometimes may address the sound made by the engine while running. A broad array of various customized mufflers and other exhaust components have been created to produce desired engine sounds. It is difficult to reconcile the two goals of near silence when the engine is idling, and a loud, throaty roar when the throttle is pressed all the way to the floor.

A search of the prior art reveals various mufflers which have been developed to provide a variable level of sound from the muffler. None are closely related to the present invention, but several include features which resemble those of the present invention. Each has proven to be less than satisfactory in its own way. The present invention has been developed for the purpose of addressing and resolving these disadvantages.

Sound absorption device or muffler for blow nozzles, U.S. Pat. No. 5,036,948 (priority Jan. 12, 1989), provides a device with a bore extending from a low-pressure side of the nozzle, at which a gas flow enters the nozzle, to a high-pressure side of the nozzle, at which the gas flow streams from the nozzle through a nozzle opening formed at an end of the bore. The device includes a sound-absorbing insert for muffling noise which results from a variation in density of the gas flow as it streams through the nozzle opening and has frequencies ranging over substantially the entire audible frequency range, the sound-absorbing insert being shaped as a truncated cone and being rigidly set into the bore formed in the blow nozzle, with the smaller face of the truncated cone being disposed directly at the nozzle opening.

Silencer/muffler, U.S. Pat. No. 8,136,629 (priority Dec. 21, 2009), provides a muffler which includes an outer tube which configures an outer wall, an inner tube provided in the outer tube and having punching holes formed therein, and a sound absorbing material filled between the outer tube and the inner tube. The muffler is attached to an exhaust pipe for exhausting exhaust gas from an engine, the number of punching holes at portions of the inner tube which have a great length to the outer tube is set greater than the number of punching holes at portions of the inner tube which have a small length to the outer tube in comparison with the portions having the great length.

Variable sound muffler system, U.S. Patent App. Pub. No. US2008/0314679 (priority Aug. 5, 2005), provides a muffler system which includes a housing having two pipes perforated with holes or other shapes that slide or rotate on top of each other. The sliding or rotating pipes allow for varying degrees of alignment of the holes and thereby allow more or less sound dampening. The control of the sound dampening is actuated by an operator via an electric switch that activates at least one of the pipes inside the muffler system to rotate or slide on each other thereby aligning the holes.

Vehicle muffler and method of assembly, U.S. Pat. No. 3,638,756 (priority Dec. 30, 1969), provides a muffler which is formed of two pieces, preferably metal stampings, in which the various chambers and passages are indented or embossed. The two pieces are joined at their peripheral edges. The muffler is tuned by manually adjusting the relative size and arrangement of chambers and passages during its installation. In one modification the position of the pieces may be adjusted relative to each other to permit variable tuning.

Exhaust muffler, U.S. Pat. No. 4,161,996 (priority Jan. 21, 1977), provides a muffler intended for noise dampening of pneumatic tools, comprising a variable flow restricting passage, an attenuation chamber and a non-variable flow restricting passage in response to the actual exhaust gas pressure. A movement dampening chamber, partly defined by the valve body, communicates with the atmosphere through a restriction opening to prevent resonance vibration of the valve body.

Performance responsive muffler for internal combustion engines, U.S. Pat. No. 4,903,486 (priority Dec. 1, 1987), provides a muffler responsive to exhaust flow. The muffler includes a body having a variable restrictor located downstream from an inlet port and upstream from an outlet port of the muffler. The variable restrictor is formed with a solid wall disposed about the valving element to define a constricting annular passageway having a cross section that varies with distance from the inlet port and from the outlet port.

The prior art inventions generally require manual operation by the user and, in at least one case, cannot change the variable restriction of exhaust flow except during installation. A triple-baffled muffler, with three hinged baffles to provide increased engine sound when the throttle is pressed, would resolve these problem. The baffles open successively as a result of increased pressure from the exhaust flow, and are thus self-actuating.

SUMMARY OF THE INVENTION

Accordingly, the invention is directed to a triple-baffled muffler. The muffler enables an engine sound that changes from very quiet when idling to louder as the throttle is pressed. The muffler provides three baffles which are hinged over the center of the muffler. The exhaust pressure travels through the muffler and pushes the baffles until they open to release the pressure. The angle of incidence of the baffles on their hinges governs the loudness of the sound.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
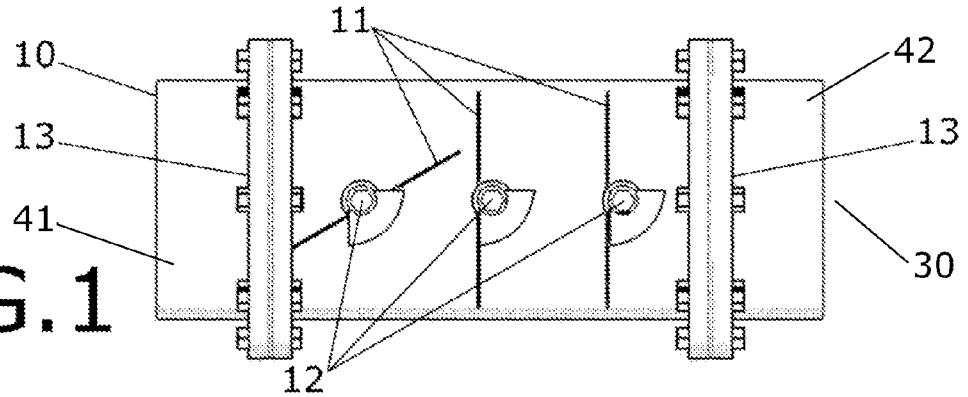
FIG. 1 is a side transparency view of the first exemplary embodiment as the exhaust gas strikes the first baffle, displaying the muffler 10, the baffles 11, the hinges 12, and the mounting plates 13.
Figure 2:
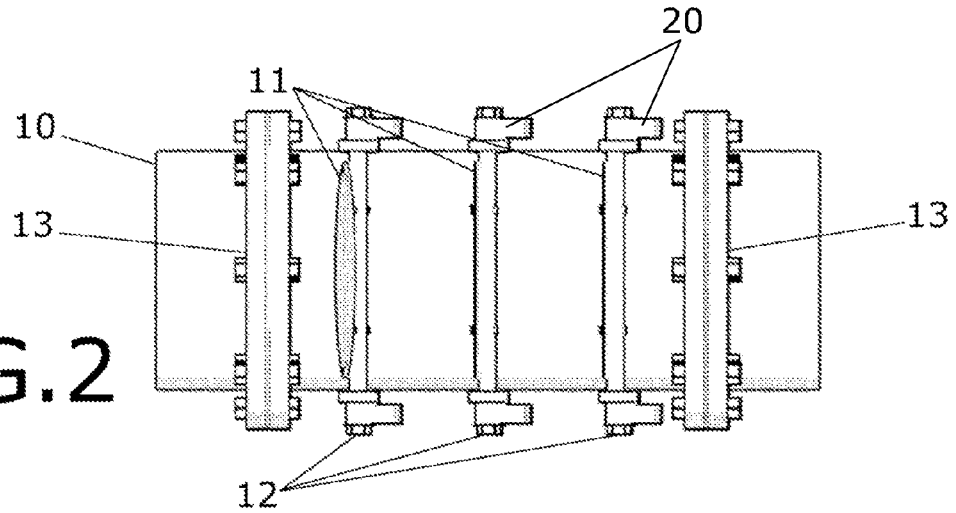
FIG. 2 is a top transparency view of the first exemplary embodiment as the exhaust gas strikes the first baffle, displaying the muffler 10, the baffles 11, the hinges 12, and the mounting plates 13.
Figure 3:
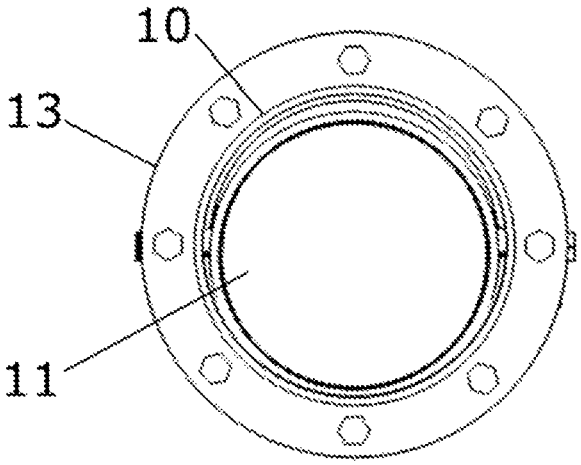
FIG. 3 is a front cutaway view of the first exemplary embodiment with no exhaust gas flow, displaying the muffler 10, a baffle 11, and a mounting plate 13.
Figure 4:
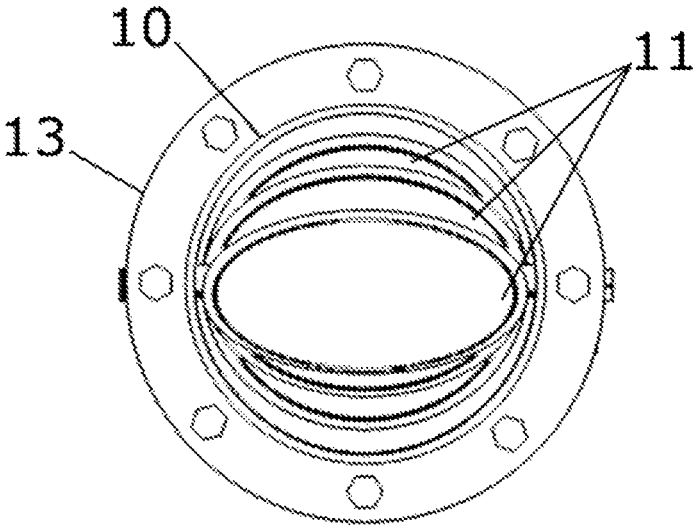
FIG. 4 is a front cutaway view of the first exemplary embodiment as the exhaust gas strikes the second baffle, displaying the muffler 10, the baffles 11, and a mounting plate 13
Figure 5:
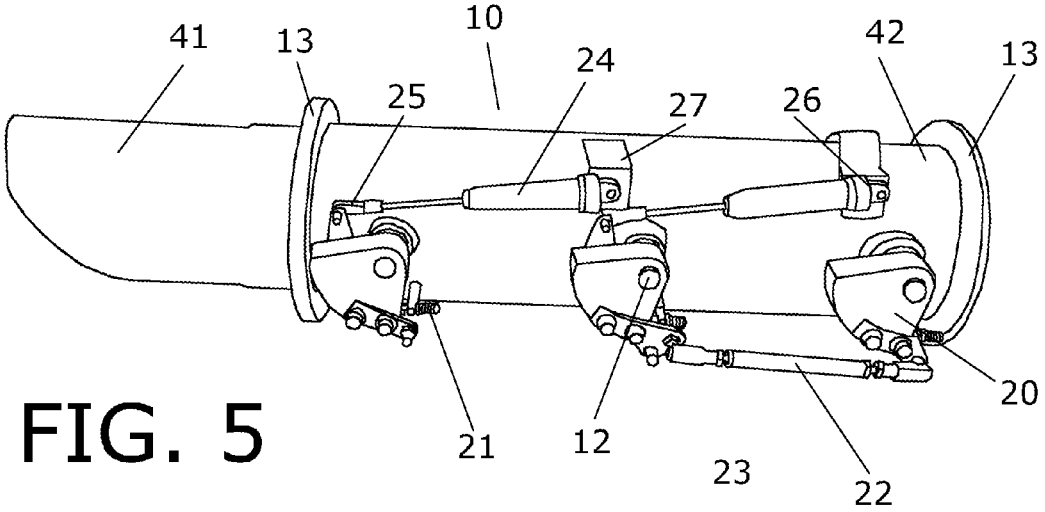
FIG. 5 is a side perspective view of the second exemplary embodiment displaying the muffler 10, the counterweights 20, the hinges 12, the mounting plates 13, the connecting rods 21, and the shocks 22.

Referring now to the invention in more detail, the invention is directed to a triple-baffled muffler 10.

The first exemplary embodiment is comprised of a muffler 10 which enables an engine sound that changes from very quiet when idling to louder as the throttle is pressed. The muffler 10 provides three baffles 11 which are hinged over the center line 30 of the muffler 10 and rotate independently of each other. The exhaust pressure travels through the muffler 10 and pushes the baffles 11 until they open to release the pressure. Counterweights 20 on the hinges 12 urge the rotation of the baffles 11 in a specific direction. Braces 21, block the counterweights 20 from rotating past a resting angle so that the baffles 11 are closed when the vehicle is idling. The braces 21 may use springs in order to dampen the impact when the baffles close. As the throttle is increased, the pressure in the exhaust also increases—the greater the pressure in the exhaust the greater the angle of incidence of the baffles 11 on their hinges 12. As the baffles 11 open further the loudness of the sound increases. Two ring-shaped mounting plates 13 are provided on the cylindrical muffler 10, near the input end 41 and output end 42 of the muffler 10. The muffler 10 is provided in a variety of sizes to fit any gasoline or diesel powered vehicle.

To use the first exemplary embodiment, the user first removes the original, factory installed muffler from the vehicle and then replaces it with the triple-baffled muffler 10, bolting it into position using the mounting plates 13 which are provided.

The second exemplary embodiment is similar to the first exemplary embodiment in that it enables the engine sound to change from very quiet when idling to louder as the throttle is increased. The second exemplary embodiment also provides a muffler 10 with three baffles 11 which are hinged over the center line 30 of the muffler 10. However, in the second exemplary embodiment at least two of the counterweights 20 are interlocked with a connecting bar 22. The connecting bar 22 interlocks the counterweights by attaching via a mount 23 on the counterweight 20 such that the interlocked counterweights rotate in synch so that the respective baffles also rotate in synch. Further, shocks 24 are provided which are similarly attached to the counterweights 20. A first end 25 is attached to the counterweight 20 and a second end of the shock 26 is attached to the mounts 27 on the muffler body. The shocks 24 provide increased resistance against the rotation of the baffles 11 such that more pressure from the exhaust and increased throttle is required in order to open the baffles 11.

The muffler 10, the baffles 11, the hinges 12, and the mounting plates 13 are preferably manufactured from a rigid, durable metal which is corrosion resistant and provides a decorative quality, such as 316 stainless steel.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A baffled muffler, comprising:

a. a cylindrical muffler having a center line;

b. a plurality of internal baffles;

c. a plurality of hinges;

d. said hinges being mounted within said cylindrical muffler along said center line;

e. said plurality of internal baffles being attached to said plurality of hinges;

f. counterweights;

g. said hinges extending through said muffler such that each end of said hinge extends outside of said muffler;

h. said counterweights being attached to the ends of said hinge i. braces;

j. said braces being attached externally on said muffler;

k. said braces being positioned such that said counterweights rotation is stopped at a resting angle wherein said baffles are closed.

2. The muffler of claim 1, wherein exhaust pressure travels through the muffler and pushes the baffles until they open to release the pressure.

3. The muffler of claim 1, wherein angle of incidence of the baffles on their hinges governs the loudness of the sound.

4. The muffler of claim 1, wherein two ring-shaped mounting plates are provided on the muffler, near the input end and output end of the muffler.

5. The muffler of claim 1, wherein the muffler is provided in a variety of sizes to fit any gasoline or diesel powered vehicle.

6. The muffler of claim 1, wherein said plurality of baffles is equal to three in number and said plurality of hinges is equal to three in number.

7. The muffler of claim 1, wherein said braces use springs such that said springs dampen impact between said counterweight and said brace when said baffler rotates to a closed position.

8. The muffler of claim 1, wherein said plurality of baffles move independently of one another.

9. The muffler of claim 1, wherein at least two of said counterweights are interlocked via a connecting bar; said connecting bar being attached to said counterweights with a mount such that said at least two interlocked counterweights rotate in synch so that said baffles associated with said interlocked counterweights also rotate in synch.

10. The muffler of claim 1, further comprising a plurality of shocks having a first end and a second end; said first end being attached to one of said plurality of counterweights and said second end being attached to a mount on said muffler; said plurality of shocks being configured to increase the resistance against rotation by the baffles.

11. The muffler of claim 6, wherein said braces use springs such that said springs dampen impact between said counterweight and said brace when said baffler rotates to a closed position.

12. The muffler of claim 6, wherein said three baffles move independently of one another.

13. The muffler of claim 6, wherein at least two of said counterweights are interlocked via a connecting bar; said connecting bar being attached to said counterweights with a mount such that said at least two interlocked counterweights rotate in synch so that said baffles associated with said interlocked counterweights also rotate in synch.

14. The muffler of claim 6, further comprising a plurality of shocks having a first end and a second end; said first end being attached to one of said plurality of counterweights and said second end being attached to a mount on said muffler; said plurality of shocks being configured to increase the resistance against rotation by the baffles.

15. A baffled muffler, comprising:

a. a cylindrical muffler having a center line;

b. a plurality of internal baffles;

c. a plurality of hinges;

d. said hinges being mounted within said cylindrical muffler along said center line;

e. said plurality of internal baffles being attached to said plurality of hinges;

f. counterweights;

g. said hinges extending through said muffler such that each end of said hinge extends outside of said muffler;

h. said counterweights being attached to the ends of said hinge;

i. braces;

j. said braces being attached externally on said muffler;

k. said braces being positioned such that said counterweights rotation is stopped at a resting angle wherein said baffles are closed;

l. at least two of said counterweights are interlocked via a connecting bar; and m. said connecting bar being attached to said counterweights with a mount such that said at least two interlocked counterweights rotate in synch so that said baffles associated with said interlocked counterweights also rotate in synch.

16. The baffled muffler of claim 15, wherein said plurality of baffles is equal to three in number and said plurality of hinges is equal to three in number.

* * * * *